US006913098B2

(12) United States Patent
Fielder et al.

(10) Patent No.: US 6,913,098 B2
(45) Date of Patent: Jul. 5, 2005

(54) SUB-REAMER FOR BI-CENTER TYPE TOOLS

(75) Inventors: Coy M. Fielder, Cypress, TX (US); Rogerio H. Silva, Spring, TX (US)

(73) Assignee: ReedEycalog, L.P., Houston, TX (US)

( * ) Notice: Subject to any disclaimer, the term of this patent is extended or adjusted under 35 U.S.C. 154(b) by 17 days.

(21) Appl. No.: 10/301,049

(22) Filed: Nov. 21, 2002

(65) Prior Publication Data

US 2004/0099448 A1 May 27, 2004

(51) Int. Cl.[7] ..... E21B 10/26
(52) U.S. Cl. ..... 175/385; 175/398
(58) Field of Search ..... 175/385, 391, 175/398, 408

(56) References Cited

U.S. PATENT DOCUMENTS

| | | | | |
|---|---|---|---|---|
| 2,124,414 A | * | 7/1938 | Goldman | 175/334 |
| 5,497,842 A | | 3/1996 | Pastusek et al. | 175/334 |
| 5,678,644 A | | 10/1997 | Fielder | 175/391 |
| 5,765,653 A | | 6/1998 | Doster et al. | 175/75 |
| 5,957,223 A | | 9/1999 | Doster et al. | 175/57 |
| 5,992,548 A | | 11/1999 | Silva et al. | 175/391 |
| 6,116,356 A | | 9/2000 | Doster et al. | 175/75 |
| 6,206,117 B1 | * | 3/2001 | Tibbitts et al. | 175/399 |
| 6,269,893 B1 | | 8/2001 | Beaton et al. | 175/391 |
| 6,340,064 B2 | | 1/2002 | Fielder et al. | 175/385 |
| 6,386,302 B1 | | 5/2002 | Beaton | 175/406 |
| 6,394,200 B1 | | 5/2002 | Watson et al. | 175/385 |
| 6,397,958 B1 | | 6/2002 | Charles et al. | 175/391 |
| 6,464,024 B2 | | 10/2002 | Beaton et al. | 175/391 |
| 6,609,580 B2 | * | 8/2003 | Beaton | 175/406 |
| 6,659,207 B2 | * | 12/2003 | Hoffmaster et al. | 175/391 |

* cited by examiner

*Primary Examiner*—Kenneth Thompson
(74) *Attorney, Agent, or Firm*—Gregory M. Luck

(57) ABSTRACT

An improved bi-center with improved directional stability and wear resistance is disclosed, said bit optimally utilizing a plurality of shaped PDC cutting elements selectively situated about the cutting surfaces of the pilot and the reamer to produce a minimal force imbalance, where further said pilot bit and the reamer are force balanced to further reduce imbalance in the operation of the tool.

11 Claims, 6 Drawing Sheets

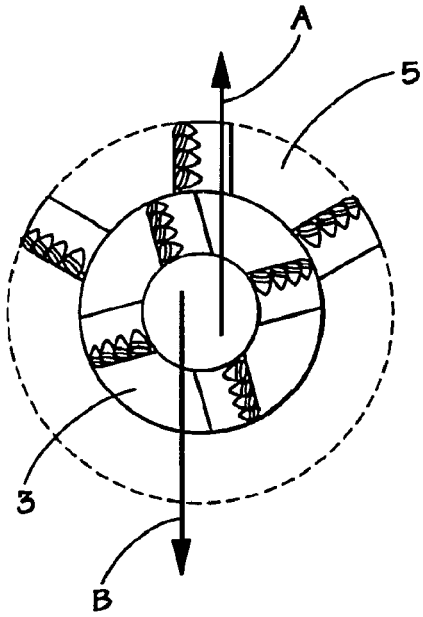
FIG. 2
FIG. 9
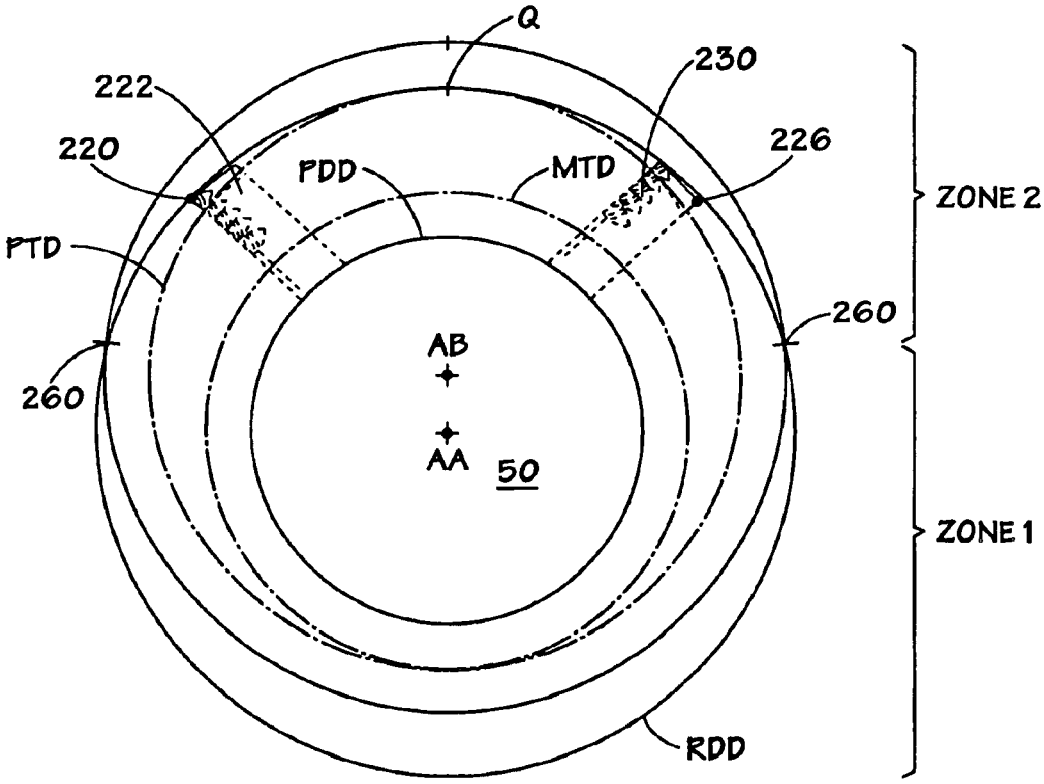

SUB-REAMER FOR BI-CENTER TYPE TOOLS

BACKGROUND OF THE INVENTION

1. Field of the Invention

The present invention generally relates to drill bits useful for drilling oil, gas and water wells and methods for manufacturing such bits. More specifically, the present invention relates to a bi-center bit or two-piece bi-center bit which includes a sub-reamer section to aid in enhancing stability of the tool when rotated in the borehole.

2. Description of the Prior Art

A significant source of many drilling problems relates to drill bit and string instability. Bit and/or string instability probably occurs much more often than is readily apparent by reference to immediately noticeable problems. However, when such instability is severe, it places high stress on drilling equipment that includes not only drill bits but other downhole tools and the drill string in general. Common problems caused by such instability may include, but are not limited to, excessive torque, directional drilling control problems, and coring problems.

One typical approach to solving these problems is to over-design the drilling tool to thereby resist the stress. However, this solution is usually expensive and can actually limit performance. For instance, one presently commercially available drill bit includes reinforced polycrystalline diamond compact ("PDC") members that are strengthened by use of a fairly large taper or frustoconical contour on the PDC member. The taper angle in this tool is smaller than the backrake angle of the cutter to allow the cutter to cut into the formation at a desired angle. While this design makes the PDC cutters stronger so as to reduce cutter damage, it does not solve the primary problem of bit instability. Thus, drill string problems, directional drilling control problems, and excessive torque problems remain. Also, because the PDC diamond table must be ground on all of the PDC cutters, the drill bits made in this manner are more expensive and less resistant to abrasive wear as compared to the same drill bit made with standard cutters.

Another prior art solution to bit instability problems is directed toward a specific type of bit instability that is generally referred to as bit whirl. Bit whirl is a very complicated process that includes many types of bit movement patterns or modes of motion wherein the bit typically does not remain centered within the borehole. The solution is based on the premise that it is impossible to design and build a perfectly balanced bit. Therefore, an intentionally imbalanced bit is provided in a manner that improves bit stability. One drawback to this method is that for it to perform properly in the borehole, the bit forces must be the dominant force acting on the bit. These bits are generally designed to provide for a cutting force imbalance that may range about 500 to 2000 pounds depending on bit size and type. Unfortunately, there are many cases where gravity or string movements create forces larger than the designed cutting force imbalance and therefore become the dominant bit forces. In such cases, the intentionally designed imbalance is ineffective to prevent the tool from becoming unstable and whirling in operation in the borehole.

Yet other attempts to reduce bit instability have incorporated devices that are generally referred to as penetration limiters. Penetration limiters work to prevent excessive cutter penetration into the formation that can lead to bit whirl or cutter damage. These devices may act to prevent not only bit whirl but also prevent radial bit movement or tilting problems that occur when drilling forces are not balanced. Furthermore, penetration limiters reduce bit rate of penetration of used too extensively but do not significantly improve stability of used too sparingly. Due to the variety of different applications, it is frequently difficult to determine to what extent penetration limiters should ve used.

While the above background has been directed to drill bits in general, more specific problems of bit instability are created in the instance of the bi-center bit. Bi-center bits have been used sporadically for over two decades as an alternative to undereamers. A desirable aspect to the bi-center bit is its ability to pass through a small hole and then drill a hole of a greater diameter. Problems associated with the bi-center bit, however, include those of a short life due to irregular wear patterns and excessive wear, the creation of a smaller than expected hole size and overall poor directional characteristics.

As in the instance of conventional drill bits, many solutions have been proposed to overcome the above disadvantages associated with instability and wear. One such proposed solution includes the use of penetration limiters to enhance the stability of the bi-center bit. As set forth above, penetration limiters prevent disadvantages in the reduction of the rate of penetration when a high number of limiters is used. Secondly, the geometry of a bi-center bit limits the number of positions for penetration limiters on one side of the bit. Placing more penetration limiters on one side of the bit can cause a force imbalance that makes the bit less stable.

Other proposed solutions include the use a stabilizer between the pilot and the reamer. The disadvantage of this is that it requires that the pilot bit produce a true size hole. Frequently, the pilot bit will create an oversized hole which prevents the stabilizer from contacting the hole wall or allows the bit to move laterally until the stabilizer does contact the hole wall which causes the reamer to produce an undersized hole.

As a result of these and other proposed problems, the bi-center bit has yet to realize its potential as a reliable alternative to undereaming.

SUMMARY OF THE INVENTION

The present invention addresses the above identified and other disadvantages usually associated with the instability and poor wear characteristics associated with drill bits, and more particularly, bi-center type downhole drilling tools.

The downhole tool of the present invention generally comprises a proximal end adapted to be operably coupled to the drill string, and a distal end. The proximal end typically comprises a threaded pin. A pilot bit is formed about the distal end face and includes a plurality of cutting elements, e.g., PDC cutting elements. A reamer section is formed on one side or quadrant of the body between the threaded pin and the pilot section. This reamer section also includes cutting elements disposed about one or more cutting blades or upsets. These cutting blades, if more than one, are configured about a radial arc of less than 180 degrees.

A sub-reamer section is positioned between the pilot and the reamer section. In one embodiment, the sub-reamer section includes cutting blades or upsets also radially distributed in an arc of at least 180 degrees, using the axis of rotation "AA" as the center, where the end points of these cutter blades extend to a distance from "AA" equal to one-half of the diameter of the maximum tool size. In this first embodiment, the cutting blades can be oriented about any radial position vis-a-vis the reamer section.

A second embodiment of the invention incorporates the same pilot and reamer sections as described in association with the first embodiment. In this embodiment, the sub-reamer section is provided with cutting blades where the maximum distance of the endpoints of these blades as measured from "AA" varies depending on the position of the blades vis-a-vis the reamer section. In this embodiment, the endpoints of the cutter blades extend a maximum distance from "AA" equal to one-half of the reamer drill diameter, but do not exceed one-half of the tool pass-through diameter, as measured from the pass-through axis "AB". These blades preferably are oriented in a radial arc about the sub-reamer section which exceeds 180 degrees.

In yet another embodiment incorporating the same pilot and reamer sections as described in association with the first embodiment, the sub-reamer section is provided with cutting blades which define endpoints where the distance of these endpoints from "AA" varies depending on the position of the cutting blades vis-a-vis the reamer section. The endpoints of these blades extend to a maximum distance from "AA" which is equal to one-half of the tool pass-through diameter, which is measured from the pass-through axis "AB". In this embodiment, the cutting blades describe a radial arc of less than 180 degrees, where this arc is disposed opposite the reamer section.

The present invention has a number of advantages over the prior art. One such advantage is enhanced stability in the borehole during a variety of operating conditions. Another advantage is improved wear characteristics of the tool.

In some applications, it is required that a pilot hole be drilled with another drilling tool before the bi-center is used or in the middle of a bi-center run. Conventional bi-centers can do this only if the pilot hole is the same size as the bi-center pilot bit or smaller. If the pilot hole is larger than the bi-center pilot bit then the bi-center will produce an undersized hole (the pilot bit will not center the bi-center in the hole). In most of these applications, the pilot hole is larger than the bi-center pilot, eliminating the use of the bi-center and forcing the use of less efficient tools. Since the sub-reamer has a larger cutting diameter than the pilot bit, a bi-center with a sub-reamer can be used in a pilot hole that is equal to or smaller than the cutting diameter of the sub-reamer.

The aforedescribed and other advantages of the present invention will become apparent by reference to the drawings, the description of the preferred embodiment and the claims.

BRIEF DESCRIPTION OF THE DRAWINGS

FIG. 2 is a schematic view of the relative forces acting on a bi-center tool;

FIG. 9 illustrates a third preferred embodiment of the invention also illustrating the reamer drill diameter, pass-through diameter, maximum tool size and sub-reamer drill diameter.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENT

A. General Structure of the Bi-Center Bit

Figure 1:
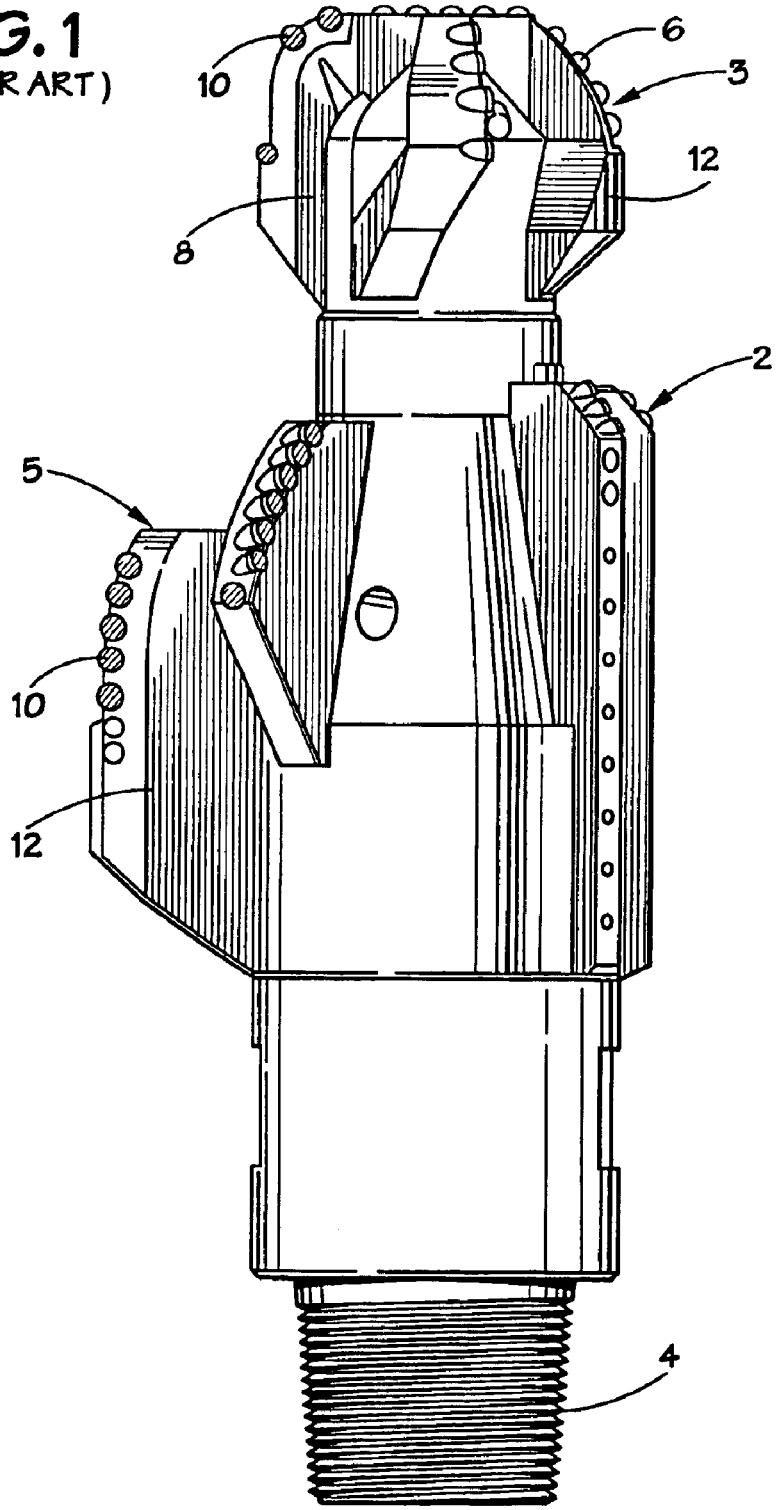
FIG. 1 (PRIOR ART)
FIG. 1 is a side view of a conventional bi-center drill bit.

FIG. 1 depicts a conventional bi-center drill bit. A bit body 2, manufactured from steel or other hard metal, has a threaded pin 4 at its proximal end for connection in the drill string (not shown), and a pilot bit 3 defining an operating end face 6 at its opposite or distal end. A reamer section 5 is integrally formed with the body 2 between the pin 4 and the pilot bit 3 and defines a second operating face.

The operating end face 6 of pilot bit 3 is transversed by a number of upsets in the form of ribs or blades 8 radiating from the lower central area of the pilot bit 3 and extending across the distal most portion and up along the lower side surfaces of said bit 3. Blades 8 are provided with a plurality of cutting elements 10 which may include polycrystalline diamond compacts ("PDC"). Removed from the distal-most end, the pilot bit 3 defines a gauge or stabilizer section which includes stabilizer ribs or kickers 12, each of which is continuous with a respective one of the upsets 8. Stabilizer ribs 12 contact the wall of the borehole (not shown) that has been drilled by the rotation of operating end face 6 and thus function to centralize and stabilize the tool and to help control its vibration within the borehole.

By its nature, a bi-center tool such as the one illustrated in FIG. 1 is inherently unstable in operation in the borehole. While a variety of designs and manufacturing techniques have been implemented to improve stability, these techniques have in some occasions been at the expense of optimum tool performance.

FIG. 2 schematically illustrates the forces acting on a bi-center downhole tool during its operation in the borehole. When the tool is operated in the borehole, the reamer section 5 exerts a large radial force in the direction indicated by arrow "A". While the pilot bit 3 can be designed to create an oppositely disposed force, here represented by arrow "B", the comparatively smaller size of the operating face of the pilot 3 versus that of the reamer 5 translates into a force imbalance where "B<A". Accordingly, a lesser but still significant resultant force is created away from the reamer section 5 in the direction indicated by arrow "A." This imbalance of forces creates instability of the tool as it is rotated in the borehole.

Figure 3:
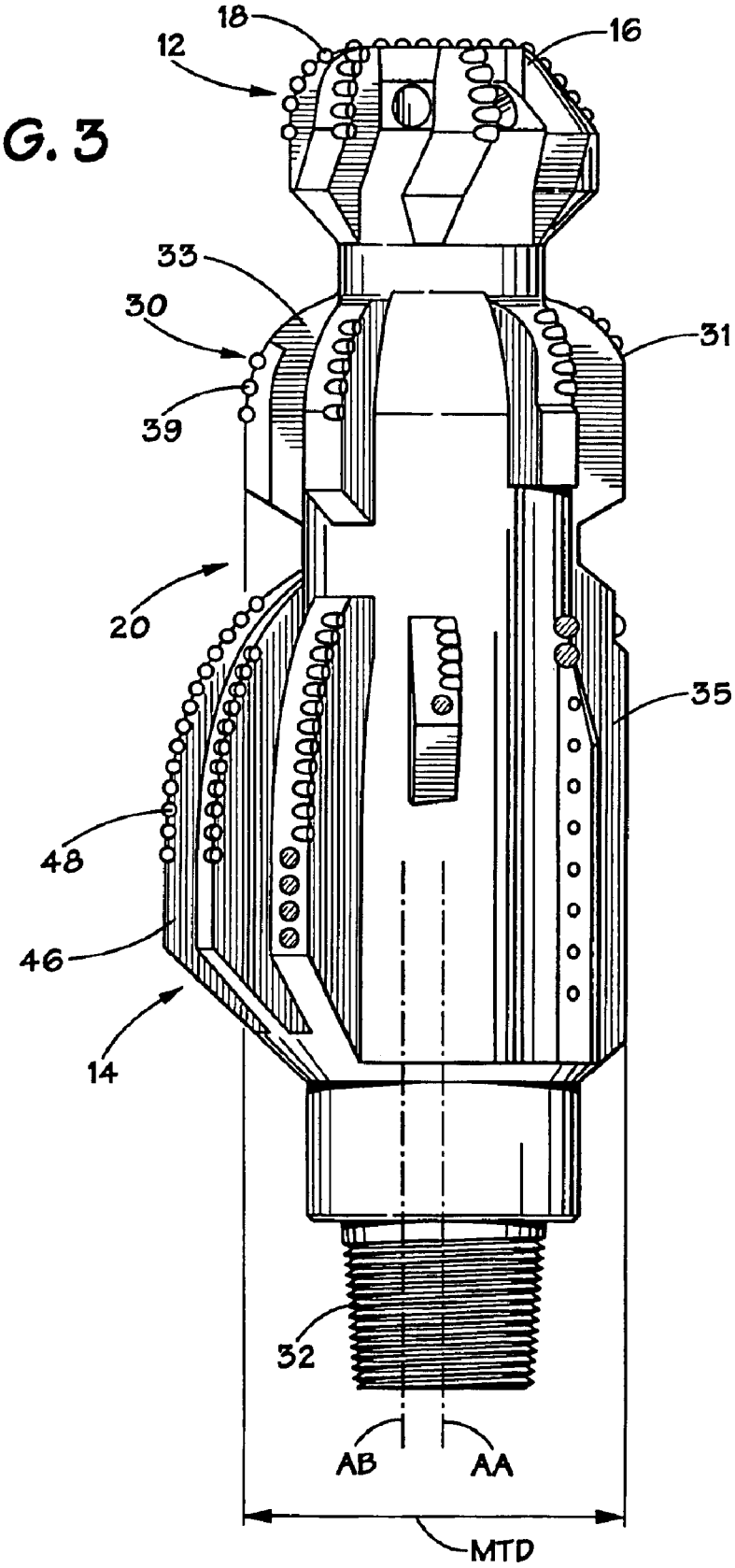
FIG. 3 is a side view of one embodiment of the bi-center tool of the present invention illustrating a sub-reamer section.
Figure 4:
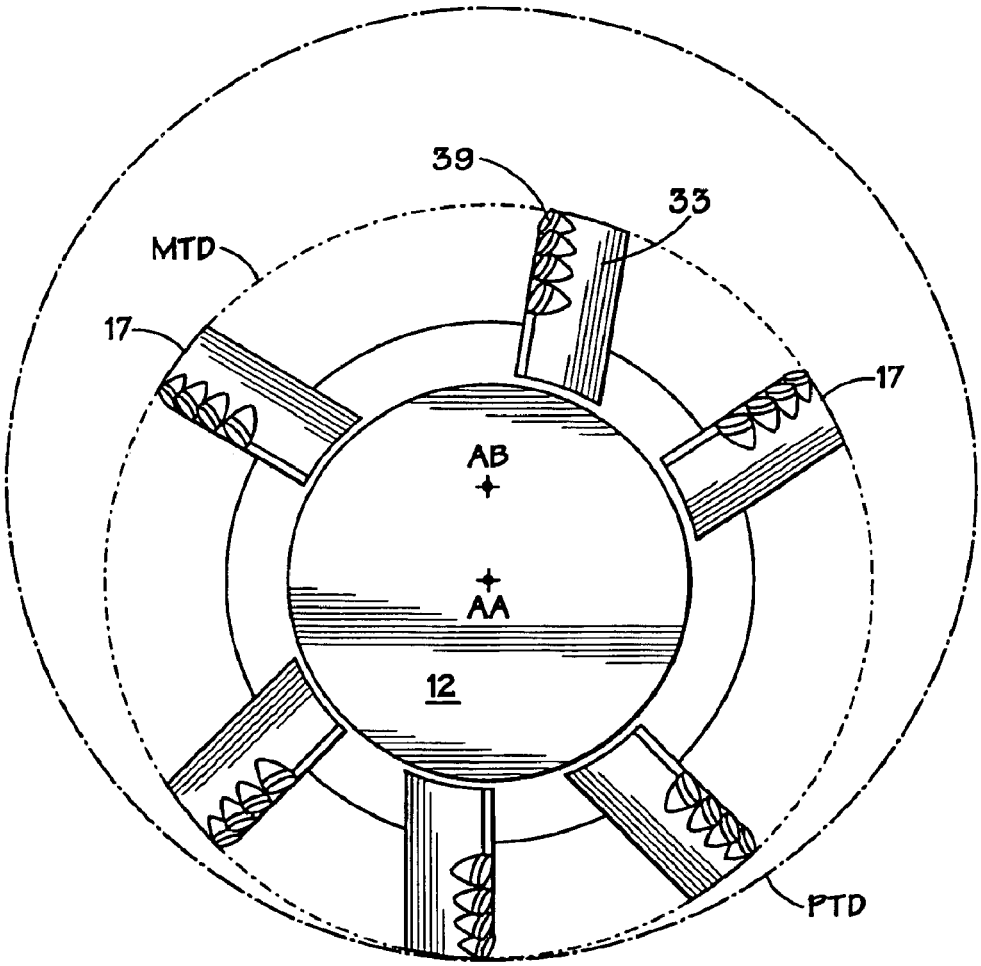
FIG. 4 illustrates an end view of the embodiment illustrated in FIG. 3 illustrating the pass-through diameter, the maximum tool diameter and the sub-reamer diameter.

FIGS. 3–4 illustrate a general embodiment of the bi-center bit of the present invention. FIG. 3 illustrates a bit body 20 which again may be milled from a high-strength material, e.g., steel. The bit body defines a proximal and a distal end. A threaded pin 32 is formed about the proximal end whereas a pilot bit section 12 is formed about the distal end. A reamer section 14 is formed intermediate the pilot section 12 and the proximal end.

Each of the pilot 12 and reamer 14 sections include one or more radial cutting blades 16 and 46, respectively. Each of these cutting blades includes an endpoint 17. Each of these cutting blades is also provided with one or more cutting elements, 18 and 48, respectively, as described above in relation to a standard bi-center bit. The cutting elements may be made of a polycrystalline diamond compact or other material suitable for cutting through formations.

The tool 20 defines a maximum tool diameter "MTD" (See FIG. 4). The maximum tool diameter "MTD" is that diameter measured from the rotational axis "AA" to the offside 35 of the reamer section 14. The maximum tool diameter "MTD" therefore defines the largest permissible diameter of a tool positioned above or below the reamer section 14 that will enable the tool to be rotated in the borehole in an unobstructed manner. The tool 20 also defines a reamer drill diameter "RDD". The reamer drill diameter "RDD" is that maximum diameter which the sub-reamer defines when rotated in the borehole about the rotational axis "AA".

In this embodiment, a sub-reamer section 30 is disposed intermediate the pilot 12 and reamer sections 14, as illustrated. The sub-reamer section 30 is also provided with one or more cutting blades 33 which are adapted to carry cutting elements 39. The endpoints 31 of those blades are positioned at specific locations based on maximum tool diameter, pass-through diameter, and the reamer drill diameter. As described above, the rotational axis "AA" is that axis about which the tool 20 is rotated when not in casing.

The tool 20 also defines a pass-through axis "AB". The pass-through axis is that axis about which the tool is rotated when in casing. The rotation of the tool about the pass-through axis "AB" defines a pass-through diameter designated "PTD".

Figure 5:
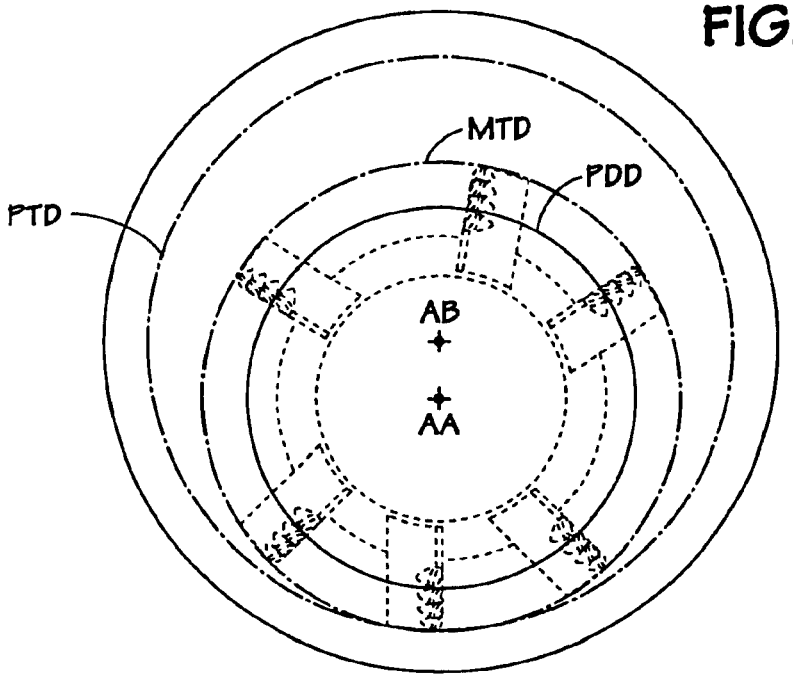
FIG. 5 is a schematic end view representation of a first preferred embodiment of the invention illustrating the reamer drill diameter, the tool pass-through diameter, the maximum tool size and the sub-reamer drill diameter.
Figure 6:
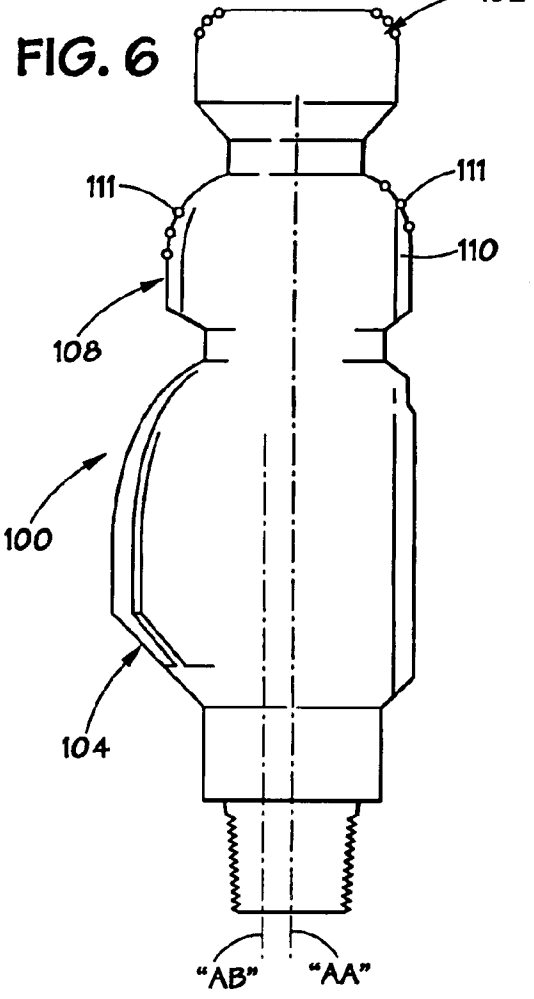
FIG. 6 is a side view of the embodiment illustrated in FIG. 5.

A first embodiment of the present invention may been seen by reference to FIGS. 5–6. In these Figures there is illustrated a bi-center tool 100 which includes a pilot bit section 102 and a reamer section 104 which are oriented about the tool in the fashion described above with respect to the general embodiment. The tool 100 defines a rotational axis "AA" and a maximum tool diameter "MTD", as also defined above in relation to the general embodiment.

A sub-reamer 108 is positioned intermediate of the pilot 102 and reamer 104 sections. In this embodiment, the sub-reamer 108 is provided with a plurality of cutting blades 110 which define endpoints 111 which extend to a distance less than or equal to the maximum tool diameter "MTD", as measured from the rotational axis "AA". These cutting blades 110 are radially distributed in an arc greater than or equal to 180 degrees about the sub-reamer 180. In a preferred embodiment, endpoints which extend the same distance from "AA" and generally extend about the full 360 degrees of the sub-reamer section 108. Each of the cutting blades 110 may include one or more cutting elements 113, e.g., PDC cutting elements, which may be affixed to cutting blades 110 in a conventional fashion. This embodiment has particular application in the use of a mid-reamer is used where the pilot bit is significantly smaller than the maximum tool size.

Figure 7:
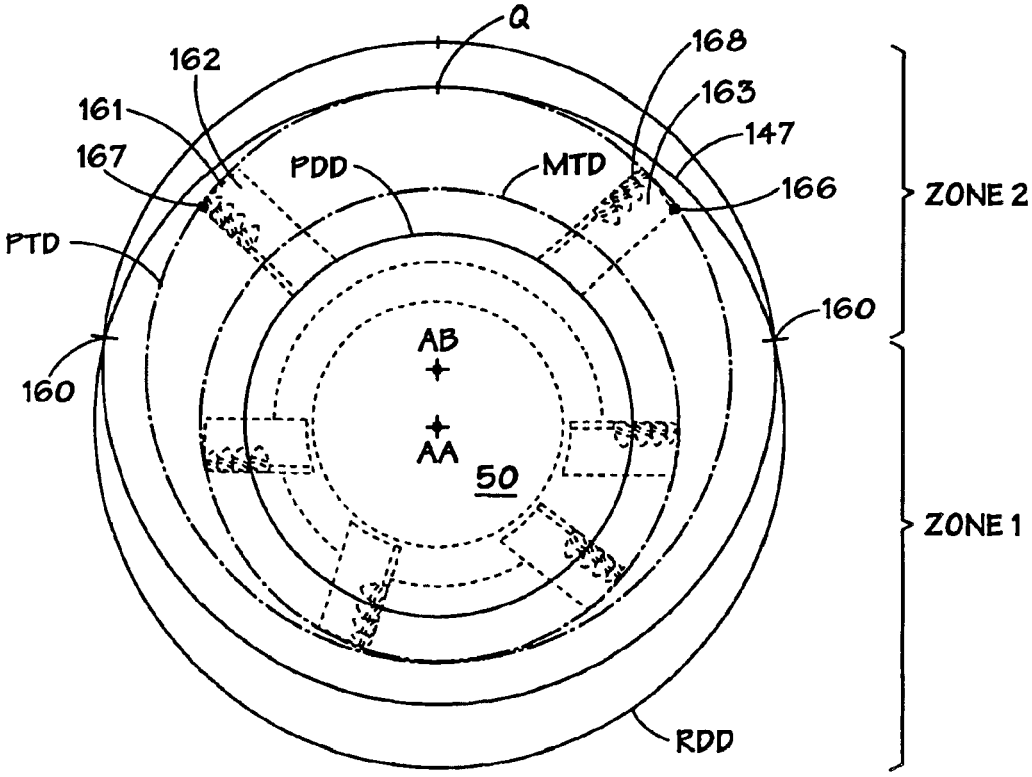
FIG. 7 illustrates a second preferred embodiment of the invention also illustrating the reamer drill diameter, pass-through diameter, maximum tool size and sub-reamer drill diameter.
Figure 8:
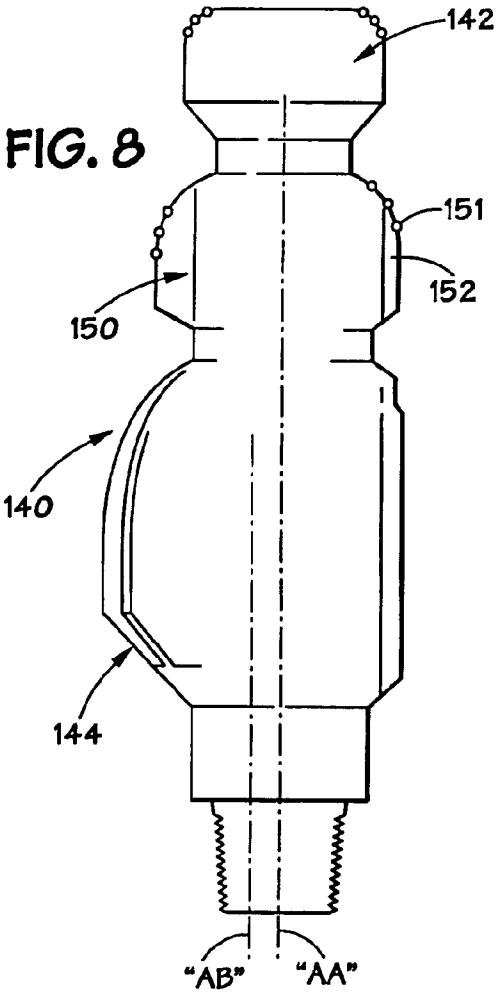
FIG. 8 is a side view of the embodiment illustrated in FIG. 7.

A second embodiment of the invention may be seen by reference to FIGS. 7–8. In these Figures is illustrated a bi-center tool 140 which includes a pilot section 142, a reamer section 144 and a sub-reamer section 150 whose respective orientation has been described above. Tool 140 defines a rotational axis "AA" and a pass-through axis "AB". The rotation of the tool about the pass-through axis "AB" defines a pass-through diameter "PTD". The maximum tool diameter "MTD" and reamer drill diameter "RDD," as defined above, are also illustrated.

In this embodiment, the cutting blades on the reamer section 144 describe an arc which further defines a midpoint "Q." This midpoint "Q" can be determined by bisecting the linear distance between the endpoint 161 on the leading edge 160 of the first blade 162 and the endpoint 163 on the trailing edge 166 of the last blade 168, as illustrated.

Consistent with previous embodiments, the sub-reamer section 150 is provided with a number of cutting blades 152, each of which define endpoints 151. Blades 152 on the sub-reamer 150 are formed in an arc where this arc is centered about a line passing through rotational axis "AA" and midpoint "Q".

In this embodiment, the intersection of the reamer drill diameter "RDD" and the pass-through diameter "PTD" defines two points of contact which are collectively designated 160 (See FIG. 7). These contact points 160 divide an end-section of the tool 140 into two different zones or regions. Zone 1 is that zone or region opposite the reamer section 144 and is disposed between contact points 160. Zone 2 is complimentary to Zone 1 and is thus aligned about reamer section 144 and centered about midpoint "Q".

As set forth above, sub-reamer section 150 includes a plurality of cutting blades or upsets 152 which are radially oriented about the tool. In this embodiment, the endpoints 151 of these cutting blades 152 is determined by their position relative to Zones 1 and 2. Those blades 152 situated in Zone 1 have endpoints which do not extend beyond the pass-through diameter "PTD". The endpoints of all cutting blades 152 situated in Zone 2 do not radially extend beyond the reamer drill diameter "RDD".

In a preferred embodiment, cutting blades 152 extend radially in an arc of at least 180 degrees. In a second preferred embodiment, no cutting blades 152 on the sub-reamer section 150 are disposed directly opposite the main reamer blades. Main reamer blades are those blades whose endpoints extend to the reamer drill diameter (RDD).

Figure 10:
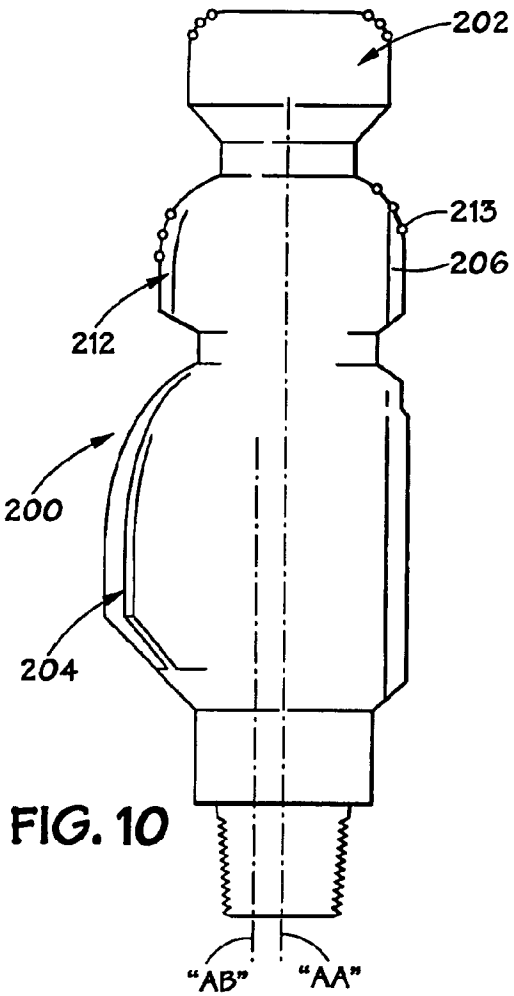
FIG. 10 is a side view of the embodiment illustrated in FIG. 9.

A third embodiment of the invention is illustrated at FIGS. 9–10 in which is disclosed a bi-center downhole tool 200 which includes a pilot section 202, reamer section 204 and sub-reamer section 212, as described above in relation to the prior embodiments. Tool 200 defines a rotational axis "AA" and a pass-through axis "AB", as illustrated in both FIGS. 9–10. Consistent with prior embodiments, the tool defines a maximum tool diameter as indicated at "MTD". The rotation of the tool about the pass-through axis "AB" defines a pass-through diameter "PTD". The rotation of the reamer section 204 about the rotational axis defines a reamer drill diameter "RDD". (See FIG. 9).

The cutting blades or upsets 206 disposed on the reamer section 204 describe an arc which further defines a midpoint "Q". In this embodiment, this midpoint "Q" is also determined by bisecting the linear distance between the endpoint of the leading edge 220 of the first blade 222 and the endpoint of the trailing edge 226 of the last blade 230, as illustrated.

Consistent with previous embodiments, the sub-reamer section 206 is provided with a number of cutting blades 212 which define endpoints 207. Blades on the sub-reamer are formed in a radial arc where this arc is centered about a line passing through rotational axis "AA" and midpoint "Q".

The intersection of the reamer drill diameter "RDD" and the pass-through diameter "PTD" defines contact points designated 260 (See FIG. 9). These contact points 260 again define two different zones. As described above, Zone 1 is formed opposite the reamer section 14, where Zone 2 is that zone complementary to Zone 1 and centered about midpoint "Q." In this embodiment, all cutting blades 212 disposed on the sub-reamer section 206 are disposed in Zone 1 and define a radial arc of less than 180 degrees. The endpoints 213 of these blades 212 does not extend beyond the pass-through diameter "PTD".

The following example demonstrates the utility of the patented invention: In a given application, it is desired to cut 200 feet of core in the middle of a bi-center run. The bi-center tool used is a 10⅝×12¼ (pass through diameter× drill diameter). In this example, a conventional bi-center would typically have an 8" diameter pilot bit. However, it is described to use an 8½" core bit to cut the core. In this case, a bi-center with a sub-reamer can be designed with a sub-reamer that has a cutting diameter of 8¾. Once the core is cut, the conventional bi-center can ream open the section of cored hole but create a hole that is smaller than the desired 12¼ for the entire 200 feet of the cored hole. This is because the 8" pilot bit is smaller than the 8½ pilot hole so the pilot bit cannot center the bi-center. The bi-center which includes the sub-reamer can create a 12¼ inch hole in this section of cored hole because the 8¾ inch sub-reamer is able to center the bi-center in the cored hole.

The foregoing disclosure and description of the invention is illustrative and explanatory thereof, and it will appreciated by those skilled in the art, that various changes in the size, shape and materials as well as in the details of the illustrated construction or combinations of features of the various bit or coring elements may be made without departing from the spirit of the invention.

What is claimed is:

1. A downhole drilling tool comprising a bit body which defines a rotational axis, a first end adapted to be detachably secured to a drill string, a pilot section on a second, opposite end of the bit body and an eccentric reamer section positioned intermediate the first and second end sections, said tool defining a maximum tool diameter and a pass-through diameter as measured from the pass-through axis, said tool further comprising:

a sub-reamer section disposed intermediate the reamer and pilot sections;

a plurality of cutting blades formed radially on said sub-reamer section about said rotational axis where said cutting blades collectively define an arc equal to or greater than 180 degrees;

said cutting blades each defining an endpoint; and where the endpoints on said cutting blades being positioned a distance less than or equal to one-half of the maximum tool diameter, as measured from the rotational axis.

2. The downhole tool of claim 1 where said cutting blades formed on said sub-reamer section are substantially disposed about a radial arc of 360 degrees.

3. The downhole tool of claim 1 wherein the endpoints defined by the cutting blades formed on said sub-reamer section are of a dissimilar distance from the rotational axis.

4. The downhole tool of claim 1 wherein the endpoints defined by the cutting blades are of the same distance from the rotational axis.

5. A downhole drilling tool comprising a bit body which defines a rotational axis and a pass-through axis, a first end adapted to be detachably secured to a drill string, a pilot section on a second, opposite end of the bit body and an eccentric reamer section intermediate the first and second end, said reamer section describing a reamer drill diameter and including one or more cutting blades which describe a radial arc having a midpoint, said tool further defining a maximum tool diameter and a pass-through diameter, where said reamer drill diameter and said maximum tool diameter being measured from the rotational axis and said pass-through diameter being measured from the pass-through axis, said tool further comprising:

a sub-reamer section disposed intermediate the reamer and pilot sections;

a first region of the sub-reamer section being defined by the intersection of the pass-through diameter and the reamer drill diameter where said first region is located opposite the reamer section;

a second region of the sub-reamer being defined by the intersection of the pass-through diameter and the reamer drill diameter, where said second region is located opposite of and complementary to said first region;

said sub-reamer provided with one or more radially-extending cutting blades which each define endpoints;

said endpoints on said cutting blades provided on said sub-reamer and disposed in said first region extending no further than one-half of the pass-through diameter, as measured from the rotational axis; and the endpoints on said cutting blades provided on said sub-reamer and disposed in said second region extending no further than one-half of the reamer drill diameter, as measured from the rotational axis.

6. The downhole tool of claim 5 where the cutting blades on the sub-reamer define a radial arc as measured about the rotational axis equal to or greater than 180 degrees.

7. The downhole tool of claim 5 wherein the endpoints defined by the cutting blades formed on the sub-reamer do not extend beyond one-half of the maximum tool diameter, as measured from the rotational axis.

8. The downhole tool of claim 5 where said bit body is formed of one or more detachable segments.

9. A downhole drilling tool comprising a bit body which defines a rotational axis, a first end adapted to be detachably secured to a drill string, a pilot section formed on a second, opposite end of the bit body and an eccentric reamer section intermediate the first and second end, said reamer section describing a reamer drill diameter or "RDD" and including one or more cutting blades which describe an arc having a midpoint Q, said tool defining a maximum tool diameter and a pass-through diameter, where the reamer drill diameter and the maximum tool diameter are measured from the rotational axis and the pass-through diameter is measured from a pass-through axis, said tool further comprising:

a sub-reamer section disposed intermediate the reamer and pilot sections;

a first region of the sub-reamer section defined by the intersection of the pass-through diameter and the reamer drill diameter, where said first region is formed opposite the reamer section;

a second region of the sub-reamer defined by the intersection of the pass-through diameter and the reamer drill diameter, where said second region is complementary to said first region;

said sub-reamer provided with one or more cutting blades which each define endpoints, where the endpoints on those cutting blades disposed in said first region extend no further than one-half of the pass-through diameter as measured from the rotational axis, and where the arc defined by said cutting blades is centered about a line drawn through the midpoint Q and said rotational axis.

10. The downhole tool of claim 9 where said bit body is formed of one or more detachable segments.

11. A bi-center bit having enhanced stability comprising:

a body defining a proximal end adapted for connection to a drill string and a distal end, where said distal end defines a pilot bit and an intermediate reamer section, where both the pilot bit and the reamer section include radially-extending upsets, each of which defines cutting surfaces, the upsets formed on the reamer section defining a leading cutting surface and one or more trailing cutting surfaces, where each of said upsets defines an endpoint;

said body defining a pass-through axis and a rotational axis;

a plurality of cutter assemblies being radially disposed about the cutting surfaces of the pilot bit and the reamer section;

the endpoint defined by the leading and trailing cutting surfaces of said reamer defining an arc having a mid-point;

said reamer section defining a reamer drill diameter as measured from the rotational axis;

a sub-reamer section disposed intermediate the pilot and the reamer sections;

first radially-extending upsets formed on said reamer section, where said first upsets are disposed in a first region defined by the intersection of the pass-through diameter and the reamer drill diameter, where the first region is opposite the mid-point of the reamer section;

second radially-extending upsets formed on said reamer section, where said first upsets are disposed in a second region formed complementary to said first region and oriented about the midpoint;

where the upsets formed in both the first and second regions define endpoints; and the endpoints on these blades disposed on said sub-reamer section and located in said first region being spaced a selected distance from the rotational axis, where said distance is less than or equal to one-half of the pass-through diameter, where the endpoints on these blades disposed in the second region of said sub-reamer section extend a distance from the rotational axis one-half of the reamer drill diameter, as again measured from the rotational axis.

* * * * *